United States Patent [19]

van den Haak

[11] 4,300,467

[45] Nov. 17, 1981

[54] ANCHOR

[76] Inventor: Rob van den Haak, Allegro 114, Krimpen and IJssel, Netherlands

[21] Appl. No.: 21,081

[22] Filed: Mar. 16, 1979

[51] Int. Cl.[3] ..... B36B 21/44

[52] U.S. Cl. ..... 114/303

[58] Field of Search ..... 114/303, 305, 301, 304

[56] References Cited

U.S. PATENT DOCUMENTS 3,518,957 7/1970 George ..... 114/303

3,712,259 1/1973 Semolic ..... 114/303

3,858,543 1/1975 Hungerford ..... 114/303

*Primary Examiner*—Duane A. Reger

*Attorney, Agent, or Firm*—Louis E. Marn; Elliot M. Olstein

[57] ABSTRACT

An anchor adapted to develop high holding power in both hard and soft anchoring ground due to flaps which are retracted within the fluke area in hard ground and extended outside the fluke area in soft ground.

1 Claim, 7 Drawing Figures

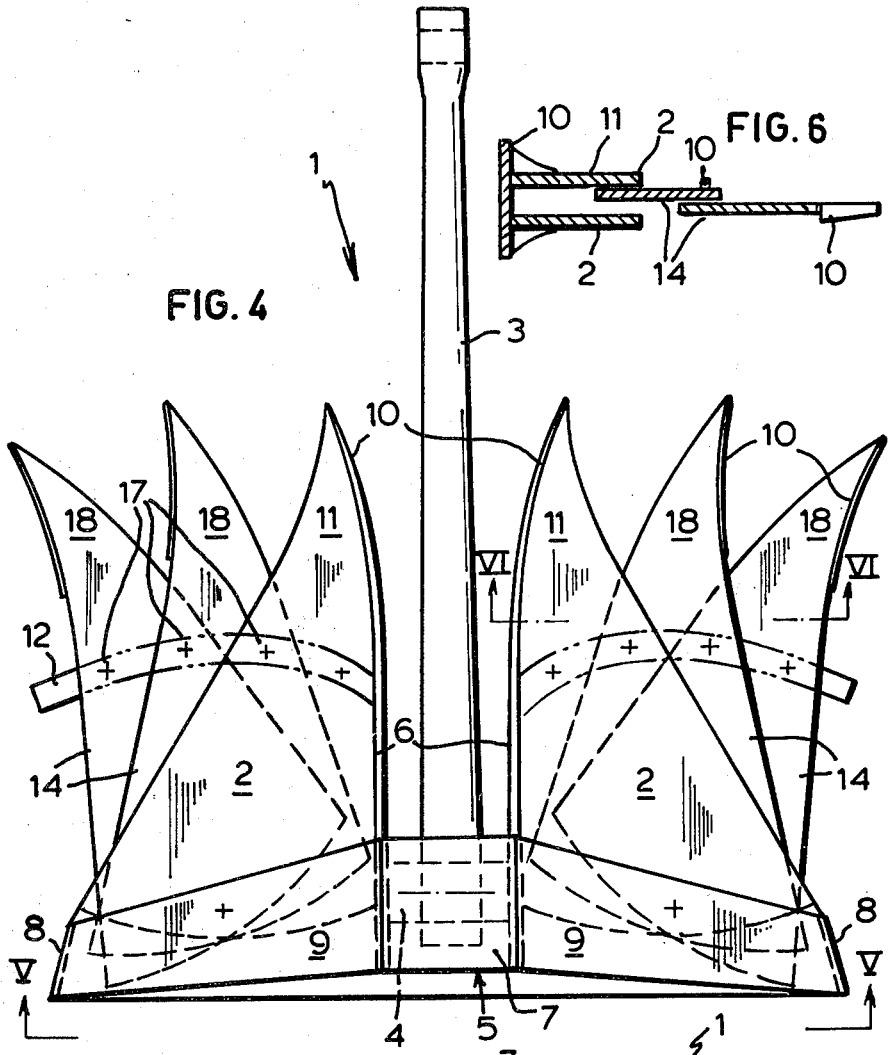
FIG. 4
FIG. 6
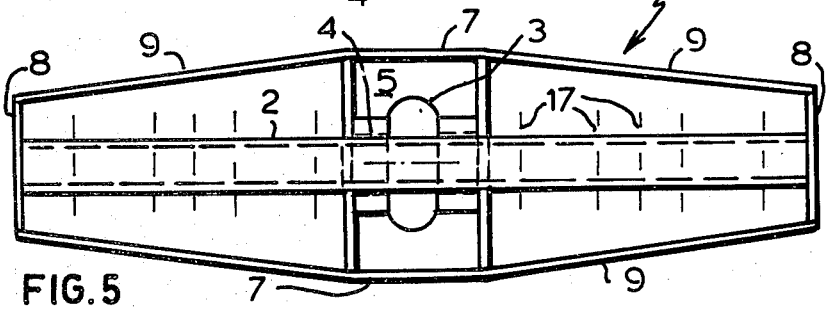
FIG. 5

ANCHOR

BACKGROUND OF THE INVENTION

The invention relates to an anchor which is adapted to be used in hard as well as soft ground. The holding power of the anchor is largely dependent on the anchoring ground. For hard ground a stronger fluke with a relatively smaller fluke area is required. For soft ground a fluke of less strength will be adequate, but the fluke area should be relatively greater. Generally one arrives at anchors of substantially the same weight for different ground types, but for those anchors of about the same weight but with different fluke area it is thus far a necessity to have several in stock to be put in operation at the rate of the ground type.

SUMMARY OF THE INVENTION

It is an object of the present invention to obviate this necessity and instead of having different anchors, just do with one and the same anchor and this is now realized by providing an anchor, the surface of which is enlargeable by flaps. In hard ground the enlargement by flaps is not necessary but when putting it in operation in soft ground the surface area can be increased by the flaps.

In one embodiment an anchor comprising a fluke, a shank which is provitally connected to the fluke, and stabilizers, is characterized by flaps which are to be fixed to the side edges of the fluke by stabilizer stocks, and preferably the flaps engage about the side edges of the fluke and the stocks are to be threaded through socket tube openings in the flaps and to be secured onto the fluke.

In a further embodiment an anchor comprising a fluke, a shank pivotally connected to said fluke, and stabilizers, is characterized by extendable flaps in the fluke. The preferred embodiment thereof is characterized in that the flaps are pivotally connected to the fluke and are movable outside the fluke area into locking positions, which can occur in that the flaps are fan-wise movable into and out of the fluke. Said locking can occur by congruent pin and hole connections in the fluke and flaps. A reinforcement thereof can be obtained by stabilizer stocks over the pin and hole connections.

Various embodiments are intended, one of which is characterized by fan teeth.

A good stabilisation of the new anchor in hard as well as soft ground is realized in that the pin stocks and/or fan teeth form front stabilizers in connection with rear side stabilizers and crown wings.

The invention is described in more detail in the following specification with reference to the drawing, in which the invention is illustrated.

BRIEF DESCRIPTION OF THE DRAWING

FIG. 4 shows a further, fan-shaped, embodiment of the new anchor type in plan view;

FIG. 5 is a rear view according to V—V in FIG. 4; and

FIG. 6 is a detailed sectional view of the fan-shaped fluke according to VI—VI in FIG 4.

DESCRIPTION OF THE PREFERRED EMBODIMENT

Figures 1, 1A, 2, 3:
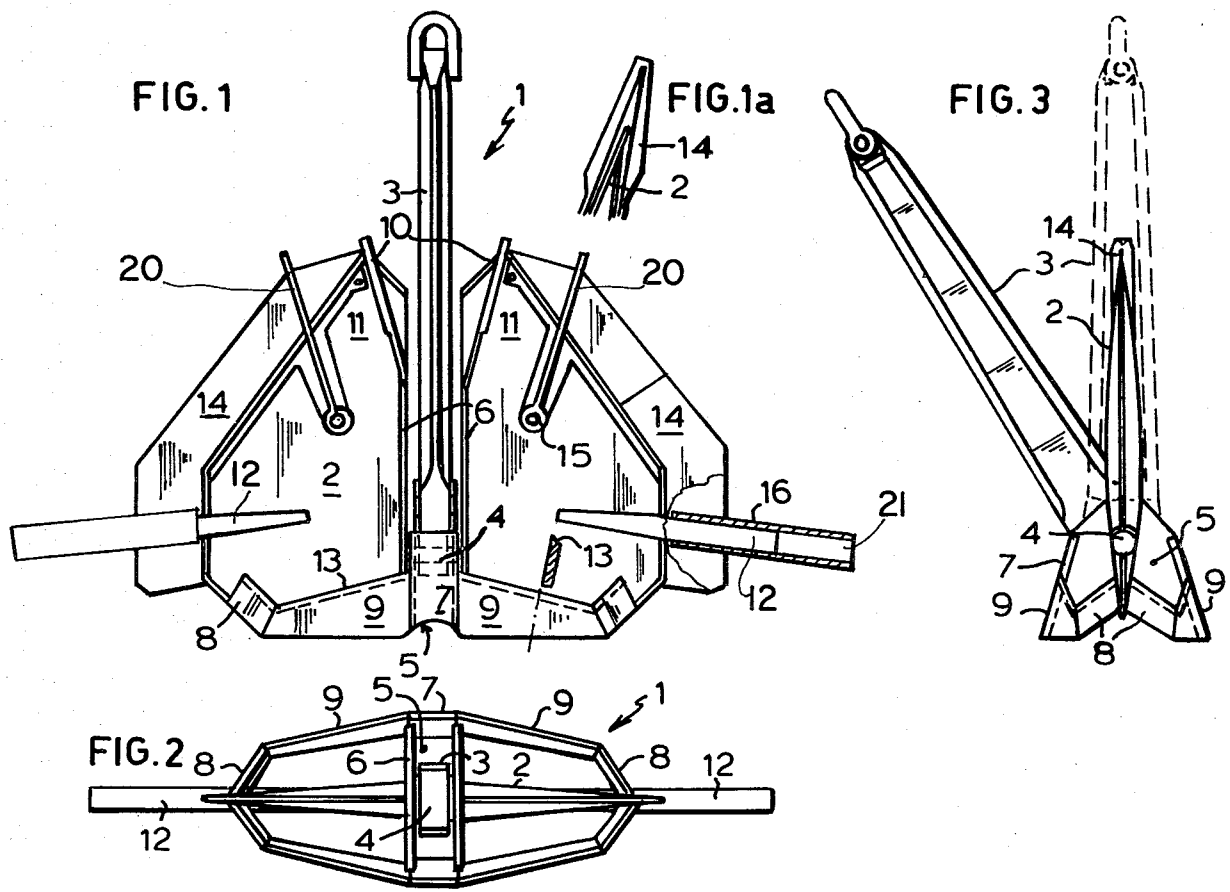
FIG. 1 is a plan view, partially in section, of an anchor with enlargeable fluke area according to the invention.
FIG. 1*a* is a detailed sectional view of a flap which is fixed onto the fluke edge.
FIG. 2 is a rear view of the anchor as represented in FIG. 1.
FIG. 3 is a side view thereof.

The drawing shows an anchor 1 comprising a two-handed fluke 2. Between the fluke hands 2 the anchor shank 3 is pivotally journaled on a shank pin 4 which is received in a box 5 defined by the inner flanges 6 of said flukes 2 and the head plates 7, the latter serving as fluke angle delimiters.

The anchors as represented in the drawing have rear stabilizers 8 comprising upstanding plates in the corners of the fluke. As shown the head plates 7 and the rear stabilizers 8 are connected by crown wings 9 which are welded thereto and assume a diverging position toward the fluke 2, which promotes the strength and stabilisation of the anchor.

The flukes 2 as represented in the drawing have a substantially triangular shape and comprise front stabilizers 10 in the form of upstanding flange plates at their fingers 11 and furthermore comprise short dismountable stocks 12 to ensure their proper position when digging-in. Properly digging-in is moreover promoted by providing the crown wings 9 with scraping-in edges 13 as schematically indicated in FIG. 1 in detailed sectional view.

The anchor embodiments as represented in the drawing are suitable for both hard ground and soft ground. That is effected so that for soft ground the anchors 1 are enlargeable by flaps 14, of which in FIGS. 1–3 an embodiment which is to be fixed onto the fluke edge is illustrated, whereas FIGS. 4–6 show an embodiment which is fan-wise movable into and out of the fluke 2.

The flap 14 as shown in FIGS. 1–3 engages about the fluke edge and is to be fixed thereonto by means of the stocks 12 and lighter pins 15, with the dismountable stock 12 being positioned within a socket tube 16 including an opening 21 mounted on the flap 14 with an inwardly extending mounting arm 20 formed on the flap 14 fixed to the fluke 2 by lighter pin 15, as shown in FIG. 1.

The anchor 1 as shown in FIGS. 4–6 has a plurality of flaps 14 which are fan-wise movable into and out of the flukes 2, and can be locked by congruent pin and hole connections 17 in their different positions. Preferably the pin and hole connections 17 are formed in the stocks 12 as shown in FIG. 4.

FIGS. 4 and 6 show flap fingers 18 provided with upstanding flange plates 10, of which flange plates 10 those on the inner flap point upwards and those on the outer flaps downwards so that the flaps can be closely collapsed.

In their collapsed condition the flaps 14 give a greater strength to the flukes 2 of the anchor 1 according to FIGS. 4–6 and in folded-out condition a greater fluke area is created for anchoring in softer ground. With the same anchor weight the fluke area can be considerably increased by the flaps.

All the anchors as shown in the drawing have a hollow fluke structure. In FIGS. 1–3 a closed hollow fluke structure is illustrated, whereas in FIGS. 4–6 an open hollow fluke 2 is represented so that the flaps 14 can be moved laterally into and out of the fluke. A flap structure which is fan-wise movable or further telescoping can, however, also be used in a single plate fluke.

An important aspect of the new anchor is furthermore that the front finger stabilizers in connection with the rear stabilizer wings ensure an good stability of the anchor. Particularly in soft ground the stabilisation by means of fan fingers is superior.

Having thus described my invention, what I claim is:

1. An anchor, which comprises:

fluke members including front and rear stabilizer members and side edge portion;

a shank pivotably mounted between said fluke members;

a stabilizer stock member mounted on and extending from each of said fluke members;

flap member means juxtaposed to said side edge portion of each of said fluke members to extend effective fluke area of said anchor, each of said flap member means including a mounting arm and a tube including a chamber for positioning said stabilizing stock member therein; and means for affixing said mounting arm to respective fluke members.

* * * * *